United States Patent [19]

Galvin

[11] 4,002,515

[45] Jan. 11, 1977

[54] HYDROXYETHYL CELLULOSE THICKENED HYDRAZINE AND SUBSTITUTED HYDRAZINES

[75] Inventor: Thomas J. Galvin, Wilmington, Del.

[73] Assignee: ICI United States Inc., Wilmington, Del.

[22] Filed: Oct. 22, 1965

[21] Appl. No.: 502,440

[52] U.S. Cl. ..... 149/36

[51] Int. Cl.[2] ..... C06B 47/08

[58] Field of Search ..... 149/36, 17

[56] References Cited

UNITED STATES PATENTS

| | | | |
|---|---|---|---|
| 3,077,072 | 2/1963 | Rice | 149/36 |
| 3,092,959 | 6/1963 | Scurlock et al. | 60/217 |
| 3,116,187 | 12/1963 | Scanlon et al. | 149/36 X |
| 3,164,505 | 1/1965 | Hsieh et al. | 149/36 |
| 3,197,348 | 7/1965 | Skolnik et al. | 149/36 X |
| 3,230,281 | 1/1966 | Carroz | 149/36 X |
| 3,232,801 | 2/1966 | Bost et al. | 149/36 X |

*Primary Examiner*—Edward A. Miller

[57] ABSTRACT

Gelled or thickened compositions comprising hydrazine, methyl hydrazine, unsymmetrical dimethyl hydrazine, or mixtures thereof, and hydroxyethyl cellulose.

8 Claims, No Drawings

HYDROXYETHYL CELLULOSE THICKENED HYDRAZINE AND SUBSTITUTED HYDRAZINES

This invention relates to thickened compositions, and, more paticularly, to thickened compositions containing hydrazine, methyl hydrazine, unsymmetrical dimethyl hydrazine, or mixtures thereof and hydroxyethyl cellulose.

Hydrazine, methyl hydrazine, and unsymmetrical dimethyl hydrazine, hereinafter collectively referred to as hydrazine compounds, are commercially available and have been widely used in both industry and research. For example, hydrazine compounds are useful as an intermediate in the manufacture of many industrially-important chemicals, such as, agricultural, textile, photographic, and other chemicals. Hydrazine compounds are also important in the manufacture of explosives and as an essential ingredient in many industrially-important processes. In addition to the above-mentioned uses for hydrazine compounds, they are powerful and efficient fuels for rockets and jet engines. Because of their low molecular weight and high heat of combustion, hydrazine compounds provide high energy output per unit weight.

Gelled or thickened hydrazine compositions are known. For example, U.S. Pat. No. 3,164,505 discloses the gelation of hydrazine with sorbitan esters. However, sorbitan esters are completely ineffective with methyl hydrazine or unsymmetrical dimethyl hydrazine, producing neither thickening nor gelation. U.S. Pat. No. 3,077,072 discloses thickening hydrazine and unsymmetrical dimethyl hydrazine with methyl cellulose. However, methyl cellulose is an inefficient thickener and with methyl hydrazine, gives an initial thickening followed by formation of bubbles and thinning. Starch also initially produces a thickening effect in methyl hydrazine solution but within a matter of hours, there is a marked loss in viscosity accompanied by the development of color suggesting that a chemical reaction is occurring leading to decomposition and instability. There is a need then for a thickener which is chemically inert to the hydrazine compounds, highly efficient, and which is effective as a thickener for all three hydrazines, thereby permitting their use in admixture with each other.

For reasons apparent to those skilled in the art, many advantages inhere in the use of solid, rigid, or viscous hydrazine compositions instead of the very fluid liquid hydrazine compounds. For example, gelled or viscous hydrazine compositions are less hazardous and easier to handle, package, store, and transport than are the unmodified liquid hydrazine compounds.

In accordance with the present invention, a hydrazine compound which normally is liquid at room temperature, is readily and efficiently converted from a water-like consistency to thickened liquids ranging from low to very high viscosity or to gels ranging from soft to rigid masses by simply mixing a minor amount of hydroxyethyl cellulose with the hydrazine compound and allowing the mixture to thicken at room temperature, either with or without agitation.

Thus, it is an object of the present invention to provide a thickening agent for hydrazine compounds.

It is a further object to incorporate with liquid compositions containing a major amount of hydrazine compounds a material which will change the fluid liquid composition to a viscous state, to a semi rigid state, or to a rigid state.

It is a further object to provide a thickened composition containing hydrazine compounds and a minor amount of thickening agent.

It is a further object of the present invention to provide a gelled or thickened fuel composition containing hydrazine compound and a thickening agent.

The above and other objects of the present invention will be apparent in the following description and in the appended claims.

These objects are achieved, in accordance with the present invention, by a thickened composition comprising:

1. a major amount of a compound selected from the group consisting of hydrazine, methyl hydrazine, unsymmetrical dimethyl hydrazine, and mixtures thereof and 2. a minor amount of hydroxyethyl cellulose.

The consistency of the thickened hydrazine compositions, which may range from viscous and pourable to semi-rigid or rigid and non-pourable, is directly proportional to the hydroxyethyl cellulose concentration. The amount of hydroxyethyl cellulose which may be used for making the thickened composition is not critical and depends to a large extent on the intended use of the thickened composition, on the amount of hydrazine compound present and on the thickening power of the particular hydroxyethyl cellulose. For most purposes, amounts of hydroxyethyl cellulose from about 0.1% to about 15% by weight, based on the weight of hydrazine compound, are satisfactory. Larger amounts of hydroxyethyl cellulose do not materially increase the viscosity of the composition and dilute the hydrazine compound. In order to avoid such dilution, it has been found more satisfactory to work in the lower part of the range, such as from about 0.2% to about 10% by weight, based on the weight of hydrazine compound present.

Any hydroxyethyl cellulose may be used as the thickening agent in preparing the thickened compositions of the present invention. The preferred hydroxyethyl cellulose is one having a molecular weight such that 1% aqueous solution and 2% aqueous solution have a Brookfield Viscosity at 25° C. of 1500–2500 centipoises and at least 25,000 centipoises, respectively. Hydroxyethyl cellulose sold under the label Natrosol 250H meets these specifications.

The following examples wll illustrate the present invention and the manner in which it may be practiced, but it is to be understood that such details are given for exemplification purposes and are not to be construed as limiting the scope of the appended claims. Numbered examples are in accordance with the invention, those designated by letter are inserted for purpose of comparison.

The following procedure was employed in each example. The indicated amount of thickening agent was placed into a test tube, 10 mls. of the indicated hydrazine compound was added by pipette, mixed well by means of a Vortex Jr. mixer, at room temperature and noted for thickening effect. Excellent denotes formation of a non-pourable or semi-rigid mass. Very good denotes formation of a highly viscous liquid, just barely pourable. Where indicated, the viscosity was measured by comparison with Gardner-Holdt viscosity tubes at b 25° C. and converted to centipoises.

| Example No. | Thickening Agent | Grams of Gelling Agent | THICKENING EFFECT Hydrazine | Methyl Hydrazine | Unsymmetrical Dimethyl Hydrazine |
|---|---|---|---|---|---|
| 1 | Hydroxyethyl Cellulose [1] | 0.5 | Excellent | Excellent | Excellent |
| 2 | Hydroxyethyl Cellulose [2] | 0.5 | Very Good | Very Good | Very Good |
| 3 | Hydroxyethyl Cellulose [3] | 0.5 | Excellent | Excellent | Very Good |
| 4 | Hydroxyethyl Cellulose [4] | 0.5 | Excellent | Excellent | Excellent |
| 5 | Hydroxyethyl Cellulose [4] | 0.25 | Excellent | Excellent | Excellent |
| 6 | Hydroxyethyl Cellulose [1] | 0.125 | — | 1000 centipoises | — |
| 7 | Hydroxyethyl Cellulose [1] | 0.25 | — | — | 15,000 centipoises |
| A | Ethyl Cellulose | 0.25 | — | — | 50 centipoises |
| B | Methyl Cellulose | 0.25 | — | Formation of bubbles in thickened methyl hydrazine followed by thinning | 1290 centipoises |
| C | Carboxymethyl Cellulose | 0.5 | None (Insoluble) | None (Insoluble) | None (Insoluble) |
| D | Sorbitan Monooleate [5] | 0.5 | Excellent | None | None |

1. Natrosol 250H
2. Natrosol 250M
3. Cellosize QP 30,000
4. Cellosize QP 52,000
5. span 80

The data clearly shows that hydroxyethyl cellulose is highly effective as a thickening agent for all three hydrazines. In contrast, methyl and ethyl cellulose produce only slight thickening of unsymmetrical dimethyl hydrazine even at 2.5% concentration. In addition, methyl cellulose appears to react with methyl hydrazine with accompanying loss of viscosity and bubble formation. In marked contrast to this, the thickened hydrazines containing hydroxyethyl cellulose were stable, showing no evidence of reaction, no discoloration or loss in viscosity on standing one week at room temperature. Carboxymethyl cellulose, a well-known aqueous thickener, is insoluble in hydrazine compounds and cannot be used.

The thickened hydrazine compounds of the present invention may also contain minor amounts of other ingredients. For example, when the thickened hydrazine compound is to be used as a propellant, the hydrazine compounds may contain minor amounts of conventional oxidizers, such as ammonium nitrate, potassium perchlorate, nitric acid, and the like. However, the thickened composition should contain a major amount of hydrazine compound, that is more than 50% by weight, and preferably between about 90 and about 99.8% by weight. The additive may be incorporated into the thickened hydrazine compounds in various ways, such as by milling the additive with the thickened hydrazine compound, by mixing the additive with the hydroxyethyl cellulose thickener prior to addition to the hydrazine compound, or by mixing the additive with the hydrazine compound prior to addition of the thickening agent.

The above examples and description are to be taken as only illustrative of the invention and a number of its preferred embodiments and it is to be understood that many further variations and modifications of the invention may be made by those skilled in the art without departing from the scope and spirit of the invention which is defined in the appended claims.

What is claimed is:

1. A thickened composition comprising:

1. a major amount of a compound selected from the group consisting of hydrazine, methyl hydrazine, unsymmetrical dimethyl hydrazine, and mixtures thereof, and
2. a minor amount of hydroxyethyl cellulose.

2. A thickened composition comprising:

1. a major amount of a compound selected from the group consisting of hydrazine, methyl hydrazine, unsymmetrical dimethyl hydrazine, and mixtures thereof, and
2. between about 0.1 to about 15% by weight, based on the weight of (1), of hydroxyethyl cellulose.

3. The composition of claim 2 wherein the hydroxyethyl cellulose comprises between about 0.2 to about 10% by weight.

4. A thickened fuel composition comprising:

1. between about 90 to about 99.8% by weight of a compound selected from the group consisting of hydrazine, methyl hydrazine, unsymmetrical dimethyl hydrazine, and mixtures thereof, and
2. between about 0.2 to about 10% by weight, based on the weight of (1), of hydroxyethyl cellulose, said hydroxyethyl cellulose forming a 1% aqueous solution having a Brookfield viscosity of 1500–2500 cps. at 25° C. and a 2% aqueous solution having a Brookfield viscosity of at least 25,000 cps. at 25° C.

5. The composition of claim 4 wherein (1) is hydrazine.

6. The composition of claim 4 wherein (1) is methyl hydrazine.

7. The composition of claim 4 wherein (1) is unsymmetrical dimethyl hydrazine.

8. A thickened composition consisting of a major amount of methylhydrazine and a minor amount of hydroxyethyl cellulose as a gelling agent.

* * * * *

UNITED STATES PATENT AND TRADEMARK OFFICE

CERTIFICATE OF CORRECTION

PATENT NO. : 4,002,515

DATED : January 11, 1977

INVENTOR(S) : Thomas J. Galvin

It is certified that error appears in the above-identified patent and that said Letters Patent are hereby corrected as shown below:

Column 1, line 5, "paticularly" should read -- particularly --.

Column 2, line 49, "wll" should read -- will --.

Column 2, line 68, the letter "b" following the word "at" should be deleted.

Column 3, line 22, "span 80" should read -- Span 80 --.

Signed and Sealed this

Nineteenth Day of April 1977

[SEAL]

*Attest:*

RUTH C. MASON
*Attesting Officer*

C. MARSHALL DANN
*Commissioner of Patents and Trademarks*